United States Patent [19]

Pipkorn

[11] Patent Number: 4,907,520

[45] Date of Patent: Mar. 13, 1990

[54] HIGH PERFORMANCE BOAT HULL WITH ANTI-SPIN SPONSON

[76] Inventor: Howard W. Pipkorn, 1622 Lake Johanna Blvd., Arden Hills, Minn. 55112

[21] Appl. No.: 200,822

[22] Filed: Jun. 1, 1988

[51] Int. Cl.[4] ..... B63B 1/20

[52] U.S. Cl. ..... 114/61; 114/290

[58] Field of Search ..... 114/56, 61, 62, 292, 114/293, 288, 289, 290

[56] References Cited

U.S. PATENT DOCUMENTS

| | | | |
|---|---|---|---|
| D. 244,481 | 6/1977 | Nescher | D12/6 |
| D. 285,190 | 8/1986 | Pipkorn | D12/314 |
| 2,503,480 | 4/1950 | Gruszecki | 114/62 |
| 2,944,505 | 7/1960 | Berge | 114/61 |
| 3,363,598 | 1/1968 | Mortrude | 114/290 |
| 3,902,445 | 9/1975 | Stolk | 114/62 |
| 3,996,869 | 12/1975 | Hadley | 114/56 |
| 4,091,761 | 5/1978 | Fehn | 114/290 |
| 4,192,248 | 3/1980 | Moyer | 114/56 |
| 4,193,369 | 3/1980 | Talamantes, Jr. | 114/56 |
| 4,465,009 | 8/1984 | Wood et al. | 114/56 |
| 4,672,905 | 6/1987 | Pipkorn | 114/56 |

FOREIGN PATENT DOCUMENTS 1106441 2/1966 United Kingdom .

*Primary Examiner*—Sherman D. Basinger

*Attorney, Agent, or Firm*—Dorsey & Whitney

[57] ABSTRACT

A tunnel hull boat with enhanced turning stability is provided. The boat hull hereof includes a pair of sponsons defining an air capturing tunnel. Each sponson includes front, middle, and rear sections delineated by distinct inclinations of the sponsons's inner sidewall. The forward sections of the sponson inner sidewalls are angled generally downwardly and outwardly to allow the sponson bow to slide towards a desired direction. The rear section of the sponson inner sidewalls are angled downwardly and inwardly to inhibit skidding of the stern in a direction opposite to a desired turn.

3 Claims, 5 Drawing Sheets

HIGH PERFORMANCE BOAT HULL WITH ANTI-SPIN SPONSON

TECHNICAL FIELD

This invention relates to high performance boat hull structures. In particular, it pertains to an improved tunnel hull with unique sponsons especially designed for enhanced turning stability.

BACKGROUND OF THE INVENTION

Tunnel hull boats are designed to trap air beneath the boat hull as the boat moves through the water. The air underneath the boat hull is compressed by the forward motion of the boat, lifting the boat above the boat's natural buoyancy water line. The hull of the raised boat has less surface area contacting the water and thus encounters less resistance to movement. A tunnel hull boat can thereby attain higher speeds than a V-bottom hull boat of comparable size and power.

Tunnel hull boats have traditionally sacrificed turning stability for higher speed performance. As will be appreciated by those skilled in the nautical arts, when a boat turns the stern of the boat tends to continue in its initial preturn direction. The effect is that of the stern skidding in a direction opposite that of the desired turn. Minimizing the amount of hull below the water line, as is done in a tunnel hull boat to attain high speeds, decreases the ability of the hull to counteract skidding of the stern. Alignment of the hull in a new, desired direction is at best delayed by the skidding action. In the extreme situation, the unchecked skidding of the stern can cause the boat to spin out of control.

A high performance hull that incorporated the speed performance advantages of a tunnel hull design without sacrificing turning stability would be a decided advantage.

SUMMARY OF THE INVENTION

The turning stability problems of conventional tunnel hull designs outlined above are in large measure solved by the tunnel hull design in accordance with the present invention. The tunnel hull design hereof includes a left and right sponson that are each divided into a front, middle and rear section. The outer edge of each section of each sponson is tilted downwardly and inwardly so that it may easily slide over the water while imparting lift to that section of the sponson. The inner edge of the front section of each sponson is angled downwardly and outwardly such that the forward sponson sections slide easily over the water surface while providing lift to the front end. The inner edge of the middle section of each sponson is essentially neutral to water movement. The inner edge of the rear section of each sponson, however, is sharply angled downwardly and inwardly, towards the hull centerline, such that the sponson rear inner edges catch the water during a turn, pulling the rear of the boat deeper into the water. The above-described inclinations in the edges of the sponsons allow the front of the boat to swing easily while the rear is securely held from lateral skidding during a turn.

DETAILED DESCRIPTION OF THE DRAWINGS

Figures 1, 2:
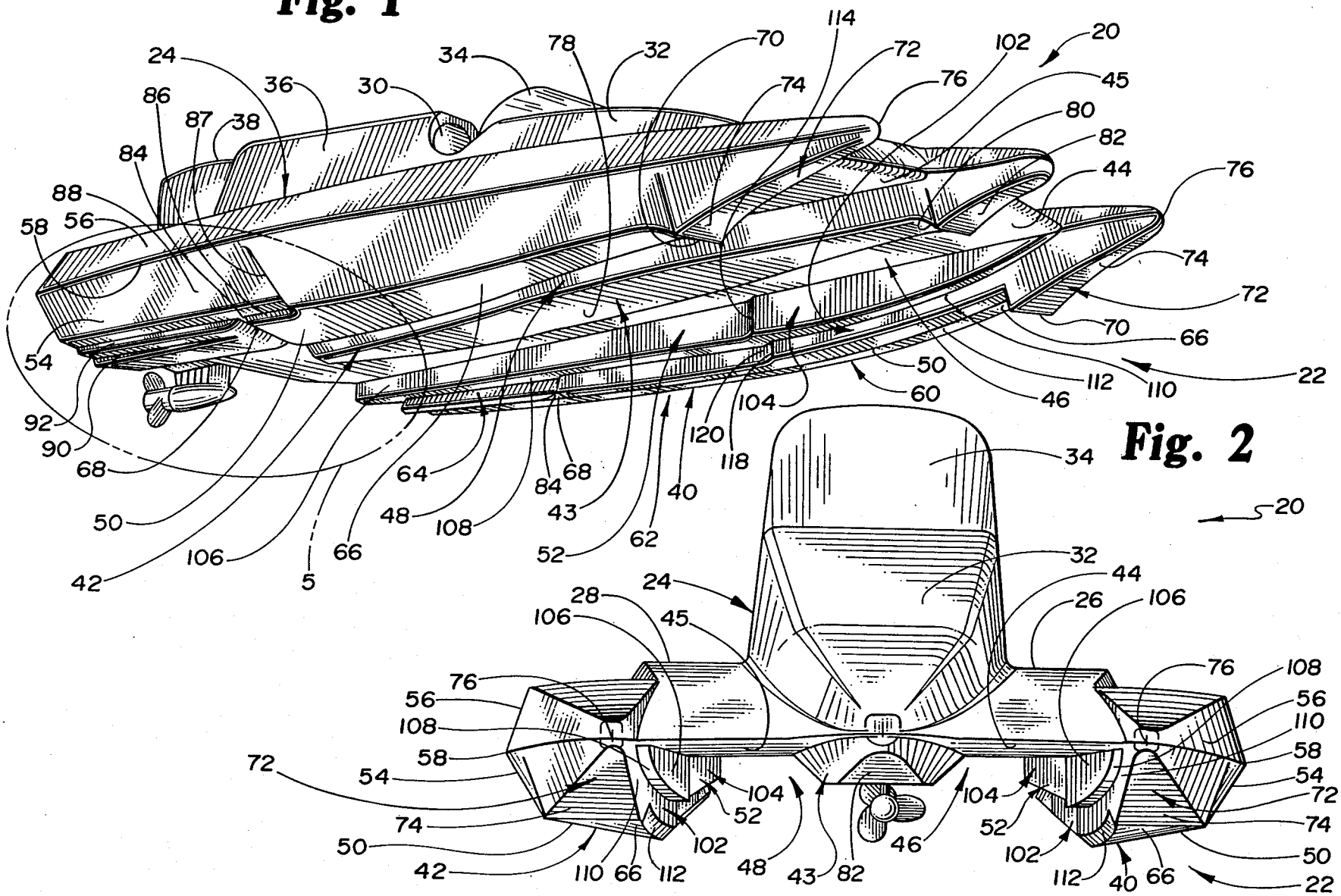
FIG. 1 is a perspective view of a boat hull in accordance with the present invention, as seen from in front and slightly below the starboard bow.
FIG. 2 is front view of the hull.

A boat 20 having an improved tunnel hull 22 in accordance with the present invention is depicted in the drawings. The top deck area 24 of the boat 20 broadly includes port and starboard decks 26, 28, cockpit 30, cowling 32, windshield 34, and fairing 36. Outboard motor 38 is carried at the stern of the boat 20. The hull 22 broadly includes port and starboard sponsons 40, 42, center pod 43, and port and starboard tunnel top walls 44, 45.

Figure 10:
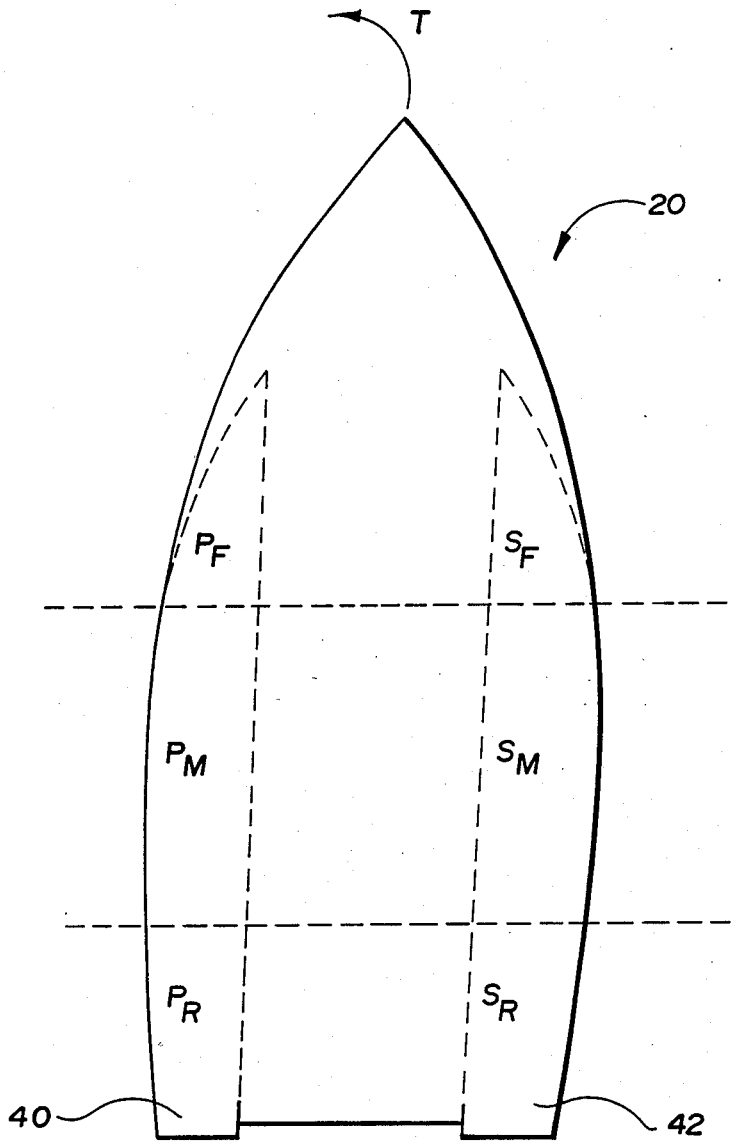
FIG. 10 is a top, schematic diagram of a boat hull, depicting the front, middle, and rear sections of the right and left sponsons of a tunnel hull boat.

Referring to FIG. 10, the port and starboard sponsons 40, 42 can, for discussion purposes, be conveniently segmented into front, middle and rear sections labeled PF, PM and PR for port front, port middle and port rear, and SF, SM, and SR for starboard front, starboard middle and starboard rear. Arrow T of FIG. 10 indicates the boat 20 in a port turn. FIG. 10 will be referred to to describe the dynamics of a boat 20 turning in the water. The structure of the boat hull 22 will then be described with reference to the turning dynamics of a boat 20.

In a port turn, the front segment of the starboard sponson SF should preferably slide over the surface of the water. If the starboard front sponson segment were caught by the water in a port turn, the boat 20 could hook (spin) or barrel rule (flip). The same effect, to a somewhat lesser degree, could occur if the starboard middle sponson portion SM, or starboard rear sponson portion SR were caught by the water. It would therefore be preferable to have each of the forward, middle and rear sponson portions of the starboard sponson slide across the water while the boat 20 is in a port turn.

It would also be preferable for the port front sponson portion PF to slide across the water surface while the boat 20 is in a port turn to prevent an uncontrolled spin of the boat 20, or a violent sharp turn. The same sliding effect, to a lesser degree, is desirable for the port middle sponson portion. Sliding of the rear sponson portion, while the boat 20 is in a rear turn, however, would contribute to uncontrolled spinning of the boat 20. As will be appreciated from the detailed description of the structure of the boat hull 22 below, the port rear sponson portion PR, in accordance with the present invention, is especially designed to inhibit the sliding of the port rear sponson portion across the water surface when the boat 20 is in a port turn. The same can be said for the starboard rear sponson portion SR when the boat 20 is in a starboard turn.

Referring back to FIGS. 1–3, the port and starboard sponsons 40, 42, center pod 43, and port and starboard tunnel top walls 44, 45 define port and starboard tunnels 46, 48. The width and depth of center pod 43 are adapted to accommodate a driver seated in cockpit 30. The port and starboard sponsons 40, 42 are mirror images of each other, and similar features of each sponson are indicated in the drawings with identical numbers.

Each sponson 40, 42 includes a sponson base 50, a sponson inner sidewall 52, and a sponson outer sidewall 54 that meets with a respective gunwale 56 along a fore and aft shear line 58. Structural variations in the base and inner and outer sponson sidewalls define sponson front, middle and rear portions 60, 62, 64 that correspond to the front, middle, and rear sponson portions schematically depicted in FIG. 10 and described above.

Figure 3:
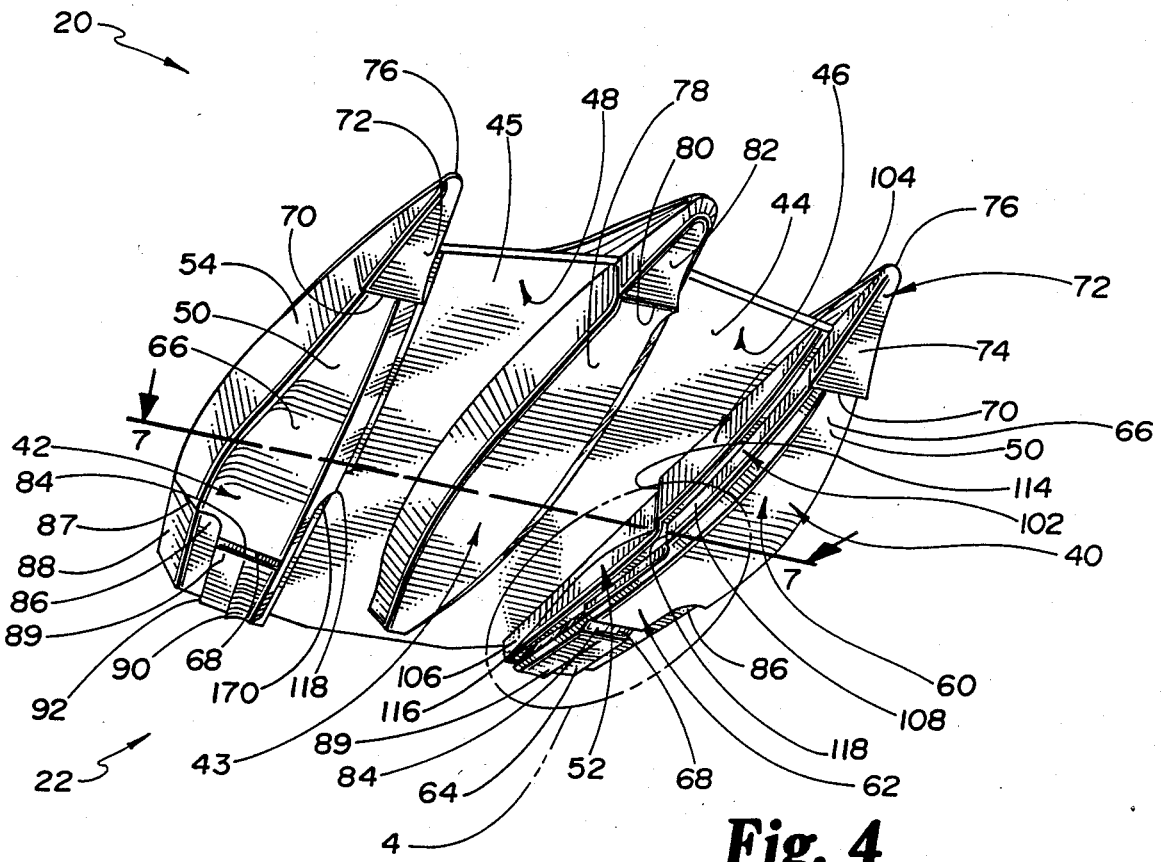
FIG. 3 is perspective view of the hull taken from the starboard bow below the keel.

Each sponson base 50 includes a generally smooth, forwardly, upwardly curved base panel 66. The base panel 66 begins at the rearward edge 68 of sponson middle portion 62 and terminates at downward step 70 at the approximate middle of sponson front portion 66. The base panels 66 are inclined outwardly and upwardly, as can best be seen in FIG. 2. The downward step 70 defines the rear wall of the sponson bow 72. As is best depicted in FIG. 3, the sponson bow 72 presents a slightly concave, forward rising bottom panel 74 extending from the step 70 to the tip 76 of sponson bow 72. Referring to FIG. 1, it can be seen that center pod 43 includes a generally smooth bottom panel 78 that terminates at its forward end at downward step 80 to present a pod bow 82 similar in design to the sponson bows 72.

Figure 6:
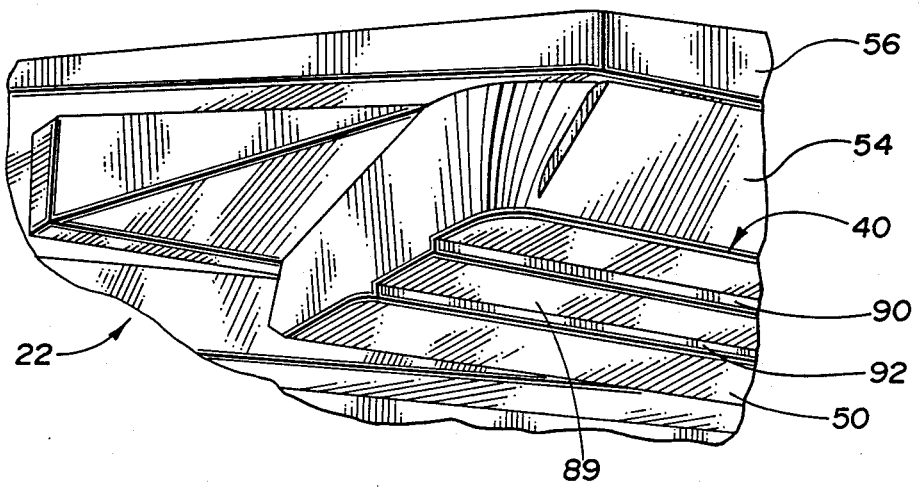
FIG. 6 is an enlarged, fragmentary, perspective view taken at 6 of FIG. 5.
Figure 7:
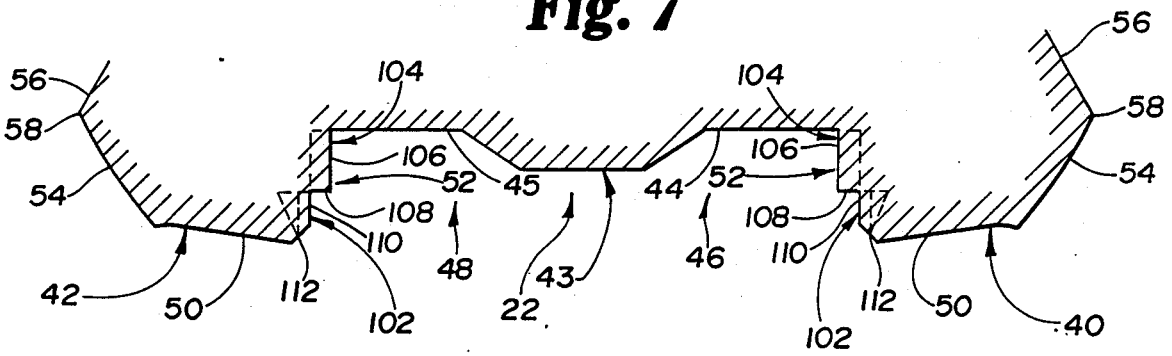
FIG. 7 is a fragmentary, sectional view taken along the line 7—7 of FIG. 3.

The rear edge 68 of each sponson middle portion 62 is defined by athwartship V-notch 84. The outboard, trailing section of each sponson base panel 66 is recessed to present a cutout 86. The leading edge of cutout 86 is aligned with an athwartship shear line 87 presented by a recessed after portion 88 of sponson outer sidewall 54. The sponsons 40, 42 extend rearwardly from V-notch 84 to present a sponson rear portion base panel 89. As best seen in FIG. 6 the sponson rear portion base panels 89 include strakes 90, 92. The sponsons 40, 42 terminate short of the boat's transom 94.

Each inner sponson sidewall 52 includes a lower and upper step 102, 104. Upper sidewall step 104 includes a generally vertical side panel 106 and a bottom strip 108 that is oriented generally perpendicular to the side panel 106. Lower sidewall step 102 includes side panel 110 recessed relative to the outboard side of the upper step sidewall 106. Chamfer strip 112 slopes downwardly in the outboard direction from the side panel 106.

Side panel 106 of upper step 104 is recessed to present a shear line 114 at the intersection of the front and middle sponson portions 60, 62. The upper side panel recess has a generally arcuate leading wall 116. The side panel 106 of inner sidewall upper step 104 continues rearwardly from the shear line 114 to the rear of the sponson.

Figure 4:
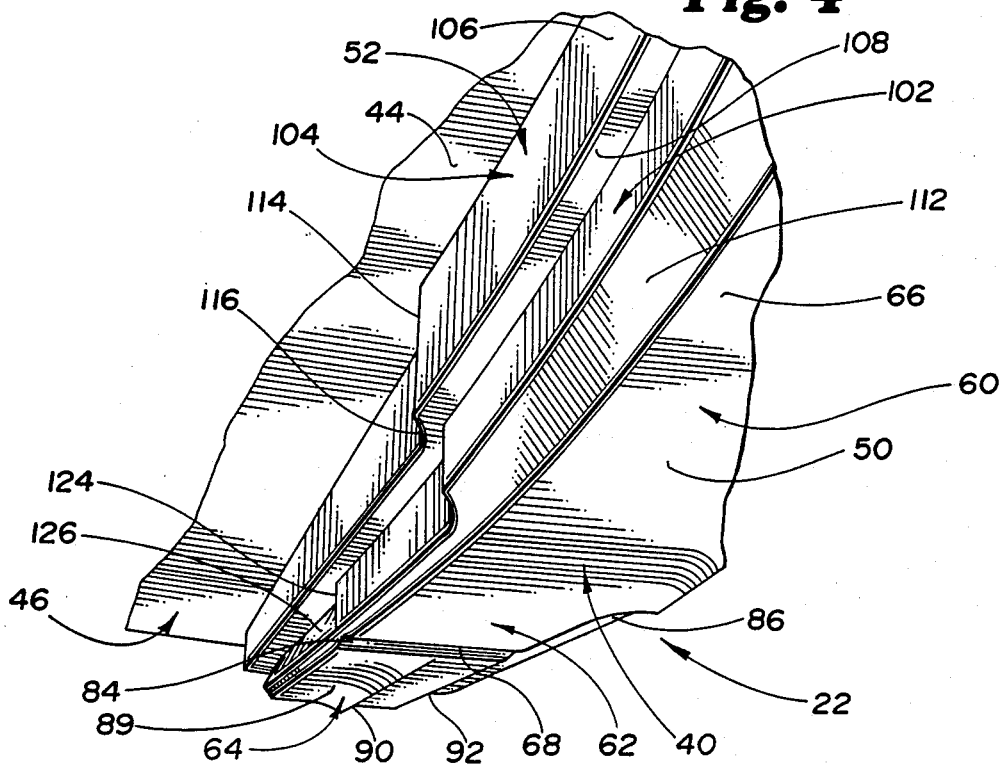
FIG. 4 is an enlarged, fragmentary, perspective view taken at 4 of FIG. 3.
Figure 5:
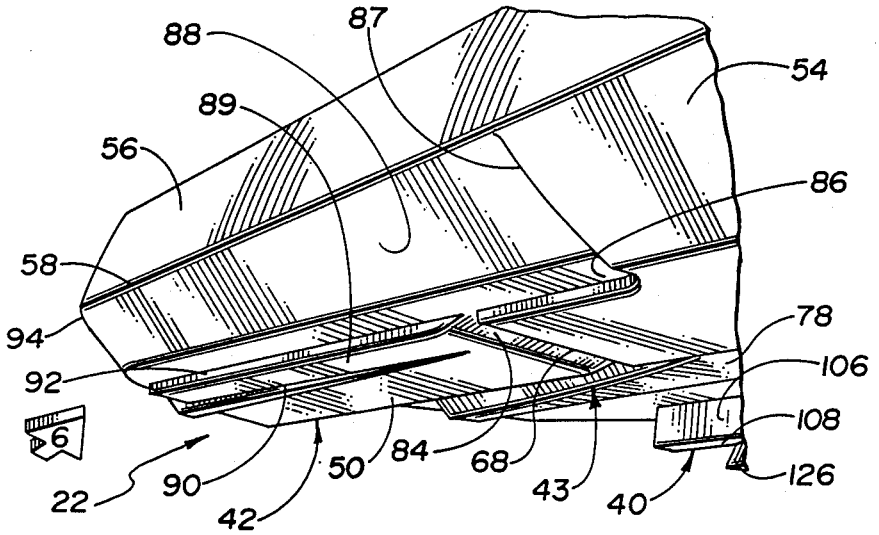
FIG. 5 is an enlarged, fragmentary perspective view taken at 5 of FIG. 1.

Side panel 110 of lower step 102 of sponson inner sidewall 52 is also recessed to present a shear line 118 at the intersection of the front and middle sponson portions 60, 62. The lower side panel recess has a generally arcuate leading wall 120. The lower step side panel 110 continues rearwardly from the leading wall 120 of the recess to present a generally vertical lower step side panel middle section. The chamfer strip 112 continues rearwardly through the sponson middle portion 62 but, as can be seen best in FIG. 4, is of substantially smaller width at the sponson middle portion 62 than it is at the sponson forward portion 60.

Side panel 110 of lower step 102 of sponson inner sidewall 52 presents a second shear line 124 at the intersection of the middle sponson portion 62 and the rear sponson portion 64. The lower step side panel 110 continues rearwardly from the second shear line 124, to present lower step side panel rear section 126. The rear section 126 of lower step side panel 110 is sloped downwardly towards the center line of the hull 22.

Figure 8:
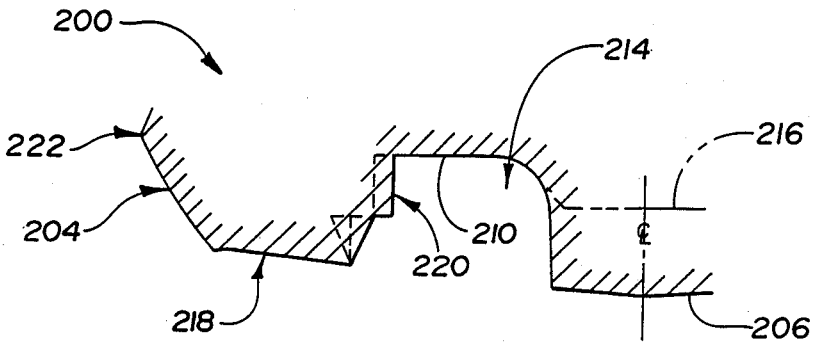
FIG. 8 is similar to FIG. 7, but showing an alternative embodiment.
Figure 9:
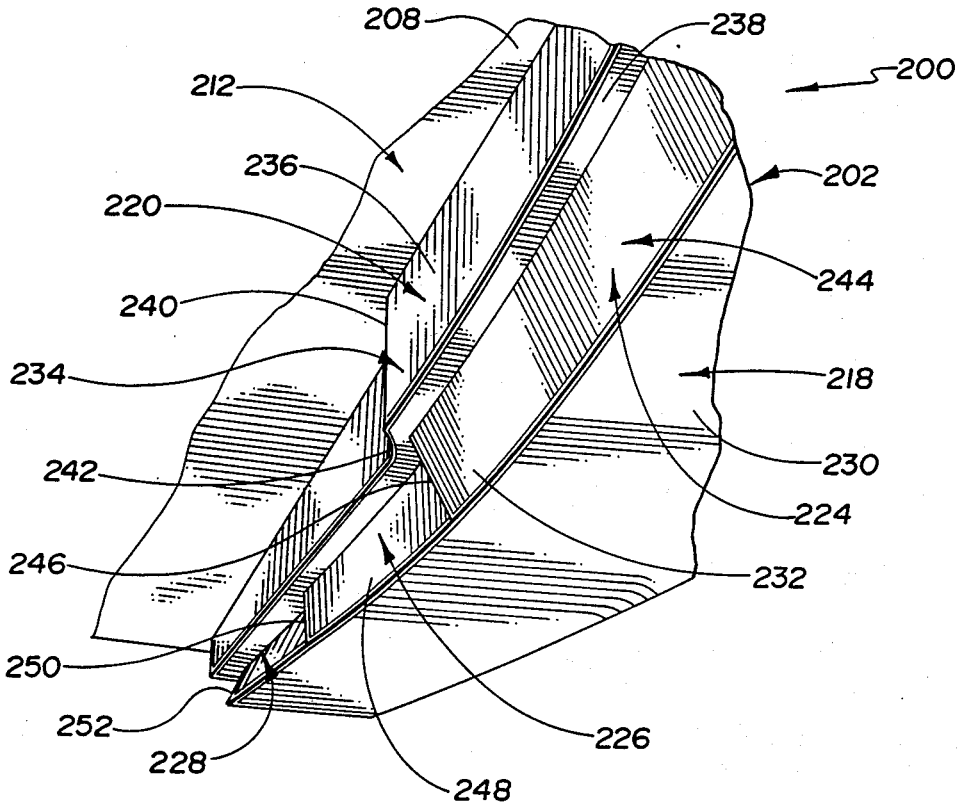
FIG. 9 is similar to FIG. 4, but showing the alternative embodiment of FIG. 8.

A second embodiment of a boat hull 200 in accordance with the present invention is depicted in FIGS. 8 and 9. The structure of the boat hull 200 in accordance with the second embodiment is in most respects similar to the structure of boat hull 22 in accordance with the first embodiment, and only the portions of boat hull 200 required to differentiate between the two embodiments is depicted in FIGS. 8 and 9.

The boat hull 200 in accordance with the second invention includes port and starboard sponsons 202, 204, center pod 206, and port and starboard tunnel top walls 208, 210. The port and starboard sponsons 202, 204, center pod 206, and port and starboard tunnel top walls 208, 210 define port and starboard tunnels 212, 214. Center pod 206 extends downwardly further than the center pod 43 depicted and described in conjunction with the first embodiment of the boat hull 22. In particular, phantom line 216 in FIG. 8 depicts the depth of the center pod in the first embodiment as compared to the depth of the pod 206 in the second embodiment of the boat hull 200.

Each of the sponsons 202, 204 includes a sponson base 218, a sponson inner sidewall 220, and a sponson outer sidewall 222. Similar to the first embodiment of the boat hull 22, the structural variations in the sponson base 218, and sponson inner and outer sidewalls 220, 222 define sponson front, middle and rear portions 224, 226, 228 that correspond to the front, middle and rear sponson portions schematically depicted in FIG. 10 and described above.

Each sponson base 218 includes a generally smooth, forwardly, upwardly curved base panel 230. Note that, in the second embodiment, the panel 230 extends across each of the forward, middle and rear sponson sections 224, 226, 228. Base panel 230 is inclined outwardly and upwardly towards the outer sponson sidewall 220.

Each inner sponson sidewall 220 includes a lower and upper step 232, 234. Upper sidewall step 234 includes a generally vertical side panel 236 and a bottom strip 238 that is oriented generally perpendicular to the side panel 236. Side panel 236 of upper step 220 is recessed to present a shear line 240 at the intersection of the front and middle sponson portions 224, 226. The upper side panel recess has a generally arcuate leading wall 242. The side panel 236 of inner sidewall upper step 234 continues rearwardly from the shear line 240 to the rear of the sponson.

Side panel 244 of lower step 232 of sponson inner sidewall 220 is recessed to present a shear line 246 at the intersection of the sponson front and middle portions 224, 226. The lower step side panel 244 is angled downwardly and outwardly along the sponson front portion 224. The lower step side panel 244 continues rearwardly from shear line 246, to present a generally vertical lower step side panel middle section 248. Note that, in the second embodiment, there is no chamfer strip similar to the chamfer strip 112 described in conjunction with the first embodiment of the boat hull 22.

Lower step side panel 244 of sponson inner sidewall 220 presents a second shear line 250 at the intersection of the sponson middle portion 226 and the sponson rear portion 228. The lower step side panel 244 continues rearwardly from the second shear line 250 to present lower step side panel rear section 252. The rear section 252 of lower step side panel 244 is sloped downwardly towards the center line of the hull 200.

The sloped inclinations of the inner and outer sponson sidewalls provide the boat hull in accordance with the present invention with improved turning stability. In particular, the downward and inward slope of each sponson outer sidewall allows the sponson to easily slide over the water while imparting a lift to the boat hull. The downward and outward slope of the forward portions of each sponson inner sidewall enable the forward sponson portions to slide easily over the water surface while turning. The sharp downward and inward slope of the rear section sponson sidewalls is especially designed to catch the surface of the water during a turn, pulling the rear of the boat deeper into the water. The stern of the boat is thereby prevented from skidding in a direction opposite to the turn and the stern is quickly aligned in the new, desired direction.

I claim:

1. An improved sponson for a tunnel hull boat, comprising:

a sponson bottom wall;

opposed inboard and outboard sponson sidewalls extending upwardly from said bottom wall, each of said sponson inboard sidewalls presenting spaced apart, generally vertical shear lines dividing the sponson into a sponson forward portion, a sponson middle portion, and a sponson rear portion, the sponson forward portion including a downwardly sloped forward panel extending outboard towards said sponson bottom wall, and said sponson rear portion including a downwardly sloped rear panel extending inboard towards said sponson bottom wall.

2. The invention as claimed in claim 1, said middle portion including a generally vertical middle panel extending downwardly towards said bottom wall.

3. The invention as claimed in claim 1, said sponson bottom wall including an upwardly sloped base panel extending from said sponson inner sidewall to said sponson outer sidewall.

* * * * *